United States Patent [19]

Hayashi et al.

[11] Patent Number: 4,747,786

[45] Date of Patent: May 31, 1988

[54] COAXIAL CABLE CONNECTOR

[75] Inventors: Hideo Hayashi; Yasushi Nishioka, both of Tsu, Japan

[73] Assignee: Matsushita Electric Works, Ltd., Osaka, Japan

[21] Appl. No.: 33,899

[22] Filed: Apr. 3, 1987

Related U.S. Application Data

[63] Continuation of Ser. No. 789,097, Oct. 18, 1985, abandoned.

[30] Foreign Application Priority Data

Oct. 25, 1984 [JP] Japan ..... 59-224531

[51] Int. Cl.[4] ..... H01R 4/66

[52] U.S. Cl. ..... 439/95; 439/97; 439/578; 439/675; 439/544; 439/565

[58] Field of Search ..... 339/177 R, 177 E, 164 R, 339/164 M, 165 R, 136 R, 136 M, 182, 183, 122 R, 122 F, 126 R, 126 RS, 125 R, 198, 123, 137, 14, 139 C, 140 C, 176 R, 126 J, 89 C, 90 C, 120, 121, 127 C, 129, 130, 131, 132, 133, 134

[56] References Cited

U.S. PATENT DOCUMENTS

| | | | |
|---|---|---|---|
| 2,162,265 | 6/1939 | Loomis | 339/117 R |
| 2,228,683 | 1/1941 | Barrelle | 339/164 R |
| 2,911,614 | 11/1959 | Davis | 339/164 R |
| 3,029,405 | 4/1962 | Buchanan | 339/164 R |
| 3,128,138 | 4/1964 | Noschese | 339/177 R |
| 3,219,963 | 11/1965 | O'Keefe | 339/177 R |
| 3,412,368 | 11/1968 | Asbridge et al. | 339/126 R |
| 3,551,874 | 12/1970 | Volinskie | 339/177 R |
| 3,566,334 | 2/1971 | Ziegler, Jr. | 339/177 R |
| 3,599,166 | 8/1971 | Cea | 339/177 R |
| 3,651,446 | 3/1972 | Sadogierskoi et al. | 339/126 R |
| 3,702,983 | 11/1972 | Chace et al. | 339/126 R |
| 4,040,699 | 8/1977 | Rasmussen | 339/126 R |
| 4,201,437 | 5/1980 | Lockyer | 339/126 R |
| 4,509,809 | 4/1985 | Wang | 339/117 R |

FOREIGN PATENT DOCUMENTS

| | | | |
|---|---|---|---|
| 57-28485 | 2/1982 | Japan . | |
| 558598 | 1/1975 | Switzerland | 339/164 M |
| 1237761 | 6/1971 | United Kingdom | 339/125 R |

*Primary Examiner*—David Pirlot

*Attorney, Agent, or Firm*—Burns, Doane, Swecker & Mathis

[57] ABSTRACT

A coaxial cable connector a body of which has, on one surface, a receptacle including first and second terminal members for electric connection thereto of an end plug of a coaxial cable and, on other surfaces, means for mounting the connector, in common, to a generally used mounting frame for house wiring modules, to be contributive to simplification of house wiring works and prevention of any deterioration of the electric connection.

8 Claims, 3 Drawing Sheets

COAXIAL CABLE CONNECTOR

This application is a continuation, of application Ser. No. 06/789,097, filed Oct. 18, 1985 now abandond.

TECHNICAL BACKGROUND OF THE INVENTION

This invention relates to coaxial cable connectors and, more particularly, to a coaxial cable connector which can be mounted to generally used wall mounting frame for a plurality of such electric wiring modules as switches, plug sockets and the like.

The coaxial cable connector of the kind referred to comprises a pair of terminal members which are electrically connected to the inner and outer conductors of an exterior-side coaxial cable connected to a TV antenna or the like installed outdoors, and is to be utilized for relaying this exterior-side coaxial cable to an interior-side coaxial cable connected to an antenna lead-in block installed on an outer body surface of a television receiver or the like.

DISCLOSURE OF PRIOR ART

An example of known coaxial cable connectors of this kind has been shown in Japanese Utility Model Publication No. 57-28485, in which the connector comprises a mounting frame U-shaped in section to be mountable to a wall surface in a room as partly embedded therein, terminal members provided in the frame for connection thereto of a coaxial or the like cable wired as disposed inside the wall and connected to an outdoor antenna or the like, and a pair of connecting terminals provided on the surface of the frame as projected thereout for connection thereto of the inner and outer conductors of another coaxial cable connected to a TV receiver or the like.

However, this known connector must be installed on to a room wall independently of the wiring modules and renders the entire house wiring work to be complicated and room interior appearance to be unfavourable. Further, the known connector has such a problem that, because the inner and outer conductors of the cable must be connected to the projected connecting terminals of the connector as exposed directly to the atmosphere with insulating coatings removed, such exposed connecting ends of the conductors are kept in a state of being exposed to moisture, dust and so on and such connecting cable part as well as contacting performance are likely to be readily deteriorated.

TECHNICAL FIELD OF THE INVENTION

A primary object of the present invention is, therefore, to provide a coaxial cable connector which allows the connecting ends of the inner and outer conductors of the coaxial cable to be connected thereto without being exposed directly to the atmosphere and can be mounted onto any general mounting frame for a plurality of electric wiring modules. According to the present invention, therefore, the connector is made contributive to simplification of the house wiring work and to prevention of the connecting ends of the coaxial cable conductors from being deteriorated to maintain their good connection.

According to the present invention, this object can be realized by providing a coaxial cable connector comprising a body provided in the front surface with a receptacle including first and second terminal members to which a plug coupled to an end of a coaxial cable is electrically connectable, a casing provided on the rear surface of the body, first and second connecting means held on the casing and electrically connected to the first and second terminal members, to which connecting means two conductors of a further coaxial cable being connectable as mutually separated and insulated electrically, and mounting means provided to the body to be engageable with the general mounting frame for the electric wiring modules.

Other objects and advantages of the present invention shall become clear from the following description of the invention detailed with reference to preferred embodiments shown in accompanying drawings.

Figure 2:
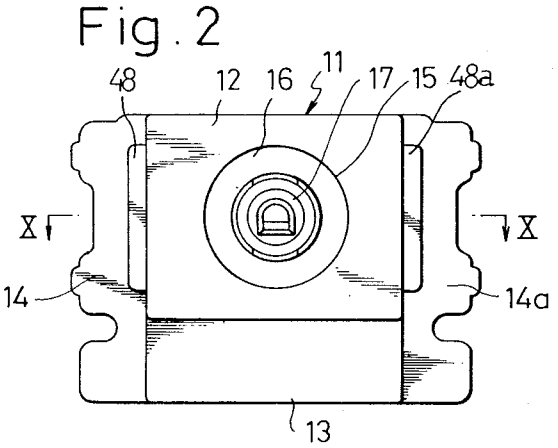
FIG. 2 is a front plan view as assembled of the connector of FIG. 1.
Figure 3:
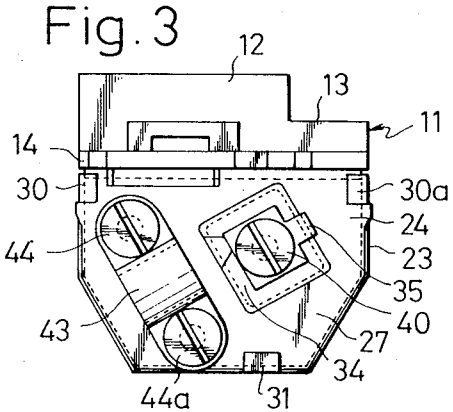
FIG. 3 is a side elevation of the connector of FIG. 2.

While the present invention shall now be described with reference to the preferred embodiments shown in the drawings, it should be understood that the invention is not to limit the invention only to the particular embodiments shown but rather to cover all alterations, modifications and equivalent arrangements possible within the scope of the appended claims.

DISCLOSURE OF PREFERRED EMBODIMENTS

Referring to FIGS. 1 to 5, a coaxial cable connector 10 according to the present invention includes a body 11 made of preferably a thermoplastic synthetic resin, which body 11 is formed to have a base part 12, a first skirt 13 expanding from a lateral side wall of the base part 12 to provide a stepped surface down from the top face of the base part, and a pair of second skirts 14 and **14*a* expanding from other opposing side walls of the base part 12 in directions perpendicular to the first skirt 13 to provide a further stepped surface down from that of the skirt 13 and continuous to the entire length thereof. The base part 12 is provided substantially in the center with a receptacle 15 including a cylindrical recess 16 and a supporting pillar 17 erected in the center of the recess 16, which pillar 17 supports in an axial through hole 18 and on the periphery respectively first and second terminal members 19 and 20. Accordingly, in the present instance, the supporting pillar 17 is formed by forcibly inserting a small cylindrical member of the resin through a bottom hole of the recess 16 into the same, with the second terminal member 20 generally of a tubular shape fitted on the periphery of the cylindrical member. The first terminal member 19 comprises a sleeve or pin contactor inserted at one end into the through hole 18 of the pillar 17 so that the top of the first terminal member 19 is accessible in the hole 18, while the other end of the member 19 is extended downward from the bottom face of the body 11. The generally tubular-shaped second terminal member 20 has a cylindrical part 21 where the member 20 is fitted to the periphery of the pillar 17, and a pair of flanges 22 and 22*a* extended from the bottom end of the part 21 to be parallel to the bottom face of the body 11. Consequently, the recess 16, support pillar 17 and first and second terminal members 19 and 20 constitute the receptacle 15** forming an electrical connector.

Figure 5:
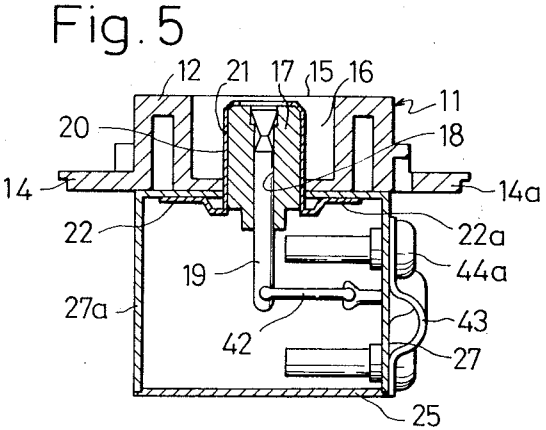
FIG. 5 is a sectional view taken along line X—X in FIG. 2 with some constituent members omitted.

Disposed on the bottom face of the body 11 is a shield casing 23 which is made of an electrically conductive plate material and comprises upper and lower halves 24 and 25 which form a polygonal box when joined together. The upper half 24 has a top wall part 26 having a central opening, and side wall parts 27 and **27*a* respectively extended downward from each of opposing side edges of the top wall part 26 and substantially in a trapezoidal shape. As seen in FIG. 5, the upper half 24 is fixed to the body 11 upon the forcible insertion of the supporting pillar 17 into the recess 16 of the receptacle 15, in such that the pillar 17 with the second terminal member 20 is inserted first into the opening of the top wall part 26 of the upper half 24 and then into the bottom hole of the recess 16, so that the top wall part 26 will be firmly held between the bottom face of the body 11 and the both flanges 22 and 22*a* of the second terminal member 20, and the flanges 22 and 22*a* parallel to the bottom face of the body 11 and abutting the rear surface of the top wall part 26 are preferably joined by spot welding with the top wall part 26. The lower half 25 is formed by bending the conductive plate material into the contour of the side wall parts 27 and 27*a*, so that the upper and lower halves 24 and 25 can be assembled together by joining interdigitatingly all peripheral edges of the lower half 25 to those of the upper half 24, with both upward bent end portions of the lower half 25 disposed crosswise to the side wall parts 27 and 27*a* of the upper half 24**.

Figure 1:
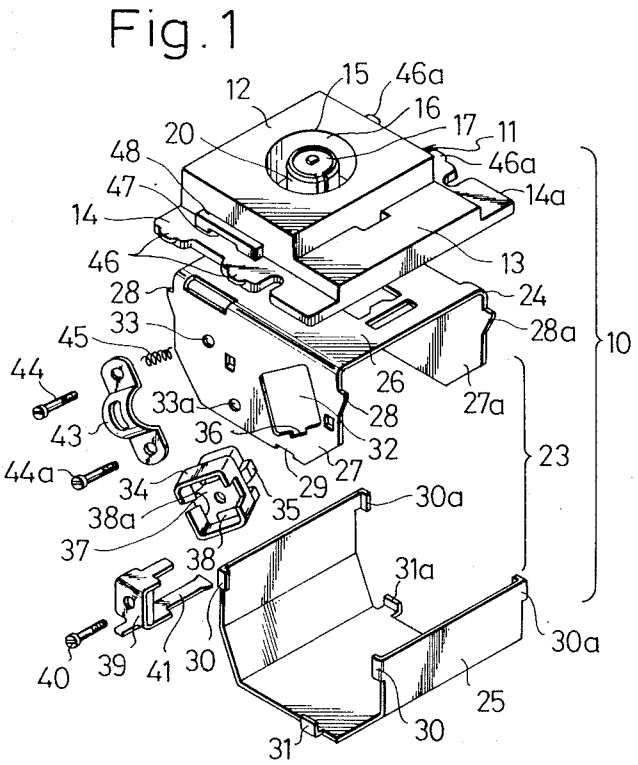
FIG. 1 is a perspective view as disassembled of a coaxial cable connector in an embodiment according to the present invention.

For the purpose of firmly securing the respective halves to each other, the side wall parts 27, **27*a* of the upper half 24 of the shield casing 23 are provided adjacent upper corner ends with short engaging projections 28 and 28*a* and preferably in their lower side edges with small notches 29 (only one is seen in FIG. 1) symmetrically positioned, while the lower half 25 is provided, at its upper end corners, with inwardly-extended short engaging lugs 30 and 30*a* which are seated on the projections 28 and 28*a* of the upper half 24 to hold its upper corners and, at its lower side edges, with short upward lugs 31 and 31*a* which are engaged in the notches 29 in the lower side edges of the upper half 24, so that the lower half 25 can be fixed to the upper half 24 which has been secured to the bottom face of the body 11**.

Further, the casing 23 is made to have, in one side wall part 27 of the upper half 24, a rectangular opening 32 and a pair of screw holes 33 and **33*a* spaced from the opening 32*a* terminal base 34 preferably having a positioning projection 35 on one side face is fitted in the opening 32 with the projection 35 engaged in a positioning notch 36 in the opening 32, and the base 34 is mounted to the side wall part 27 as inserted by one half of the height of the base. The terminal base 34 made of an insulating material is formed to have in the top surface a recess 37 having therein small holes 38 and 38*a*, and a substantially U-shaped connecting member 39 is fixed in the recess 37 by inserting both leg parts of the U-shaped member 39 into the small holes 38 and 38*a* and driving a screw 40 through a central hole of the member 39 into an axial hole of the base 34. One leg part 41 of the connecting member 39 made longer than the other is passed through the terminal base 34 to extend to the interior of the shield casing 23, and is electrically connected through a wire 42 to the lower end of the first terminal member 19**.

A further cable-holding connecting member 43 substantially semicircular-shaped in the center is secured to the same side wall part 27 of the casing 23 by means of a pair of screws 44 and **44*a* passed through holes in both arms of the member 43 and fastened into the pair of screw holes 33 and 33*a* of the side wall part 27. A coil spring 45 is fitted on one of the screws, 44, so that one arm side of the connecting member 43 will be urged to float when the screw 44 is loosened and an end of a coaxial cable (not shown) for connecting the connector to an outdoor antenna may easily be fitted between the loosened connecting member 43 and the side wall part 27 to be thereby held at the exposed outer conductor of the cable with the screw 44 fastened. Thus the outer conductor of the cable is electrically connected through the holding connecting member 43 and shield casing 23 to the second terminal member 20, while the inner conductor of the cable is brought into contact, as fastened by the screw 40, with the connecting member 39 for electric connection through the member 39 and wire 42 with the first terminal member 19, as sufficiently separated and insulated from the outer conductor. Here, the shield casing 23 is made to have the same potential as the outer conductor of the cable, and the casing 23 achieves an effective shielding of the transmission line between the inner conductor and the first terminal member 19 from any external electric field, as all elements for the line are enclosed within the casing. It will be appreciated that the connectors 43, 40 are disposed on surfaces of the side walls 27, 27*a* facing laterally away from a longitudinal axis of the receptacle 15**.

The body 11 is provided, on the other hand, with means engageable with a generally available wiring-module mounting frame for mounting the connector thereto. That is, the body 11 is made to have, at the respective extended end of the second skirts 14 and **14*a*, a pair of further extended lugs 46 and 46*a* and, at respective joining corners of the side walls of the base part 12 and second skirts 14 and 14*a*, an insertion hole 47 defined by a corner extrusions 48 or 48*a*. The extended lugs 46 and 46*a* are provided fo adapting the connector to its mounting to the frame which is plastic-made, while the insertion holes 47** are for adaption to the frame metal-made.

Figure 6:
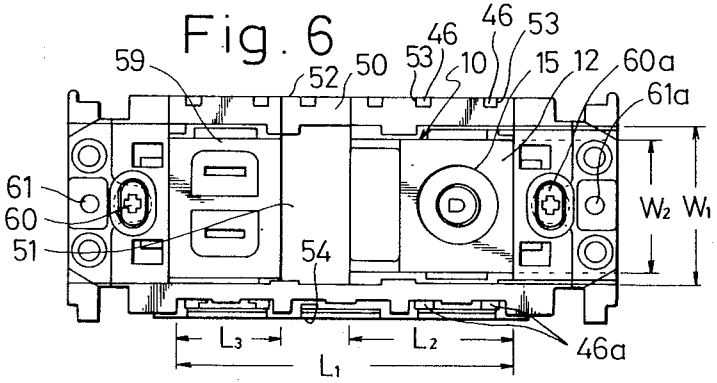
FIG. 6 is a plan view of the connector of FIG. 2 in a state where the same is mounted to a general plastic-made mounting frame for the wiring modules, along with a plug socket as an example of the modules.
Figure 7:
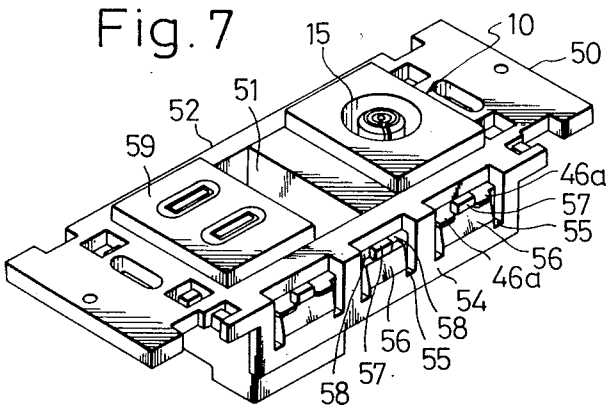
FIG. 7 is a perspective view of the connector in the state of FIG. 6.
Figure 4:
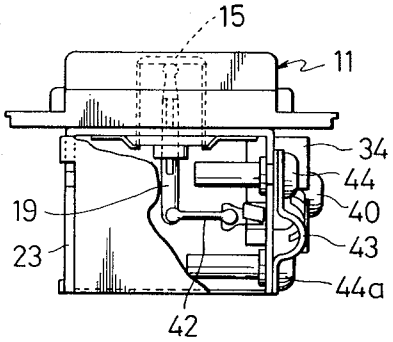
FIG. 4 is another side elevation of the connector of FIG. 2, with a part of the casing removed for showing the interior of the connector.

Referring first to the mounting of the connector 10 to the plastic-made mounting frame with reference to FIGS. 6 and 7, the mounting frame 50 generally of a long rectangular shape is made to have a wide mounting opening 51 and longitudinal side walls 52 and 54 extended perpendiculary with respect to the plane of the opening 51 to be U-shaped as seen endwise. One side wall 52 has, along one side edge of the frame, holes 53 for engaging therein the lugs 46 of the skirt 14 of the body 11, the other side wall 54 of the mounting frame 50 is provided with engaging apertures 55 opened at the other side edge, and the side wall 54 is formed to include pliable support tongue pieces 56 respectively terminating adjacent the side edge. The lugs 46 and the holes 53 define a projection and slot connection. The support tongue pieces 56 are provided respectively at their top with a protrusion 57 to define on its both sides shoulders 58 for receiving the lugs **46*a* of the other skirt 14*a* of the body 11. Therefore, by engaging, for example, the lugs 46 of the skirt 14 from the side of the extended side walls 52 and 54 into the holes 53 of the mounting frame 50 with the base part 12 fitted into the mounting opening 51 to slightly project thereout, while causing the lugs 46*a* of the other skirt 14*a* to be slid along the pliable tongue pieces 56 to engage in the apertures 55 and to rest on the shoulders 58 with the pliable tongue piece 56 resiliently bent meanwhile, the coaxial cable connector 10 can be firmly mounted to the mounting frame 50 when the bent tongue piece 56 restores to the original position. As shown, the mounting is performed with respect, in common, to the frame 50 to which such wiring module 59** as a plug socket is already or later mounted.

It is preferable for mounting the coaxial cable connector 10 according to the present invention to employ one of the mounting frames which is designed in particular for use with three wiring modules. In this case, the length $L_1$ of the opening 51 of the mounting frame 50 is set to be substantially 3 times as large as the width $W_1$ of the opening 51, and the width $W_2$ of the base part 12 of the connector body 11 and of the wiring module 59 as well is set to be only slightly smaller than the width $W_1$ of the opening 51 to be close thereto. Taking into consideration the functions of the shield casing 23 and the respective members mounted thereto, on the other hand, the length $L_2$ of the connector body 11 is set to be larger than the width $W_1$ of the opening 51 so that the body 11 may be spaced at least by the length of the first skirt 13 from the module 59 having the length $L_3$ substantially equal to the width $W_1$ of the opening 51. This length $L_2$ is made optimumly 1.5 times as large as the length $L_3$ of the module 59 which is close to the opening's width $W_1$. When two of the coaxial cable connectors 10 are desired to be mounted to the mounting frame 50, on the other hand, the first skirt of one of the connectors 10 should be provided to extend in opposite direction to the first skirt 13 of the body 11 of the other connector of the foregoing embodiment, so that the two connectors will be mounted on the frame 50 with their first skirts disposed face-to-face to be spaced from each other by a distance corresponding to the length $L_3$ of the wiring module, and thereby any interference can be prevented from occurring between the both connectors.

The mounting frame 50 is to be secured to a fixing frame or box (not shown) fixed as embedded in a room wall, by fastening screws passed through holes 60 and **60*a* made adjacent longitudinal ends of the frame 50 to the fixing box. A known decorative plate (not shown) may be thereafter secured over the frame 50 with screws passed through the decorative plate and fastened to holes 61 and 61*a* at the longitudinal ends of the frame 50**.

Figure 8:
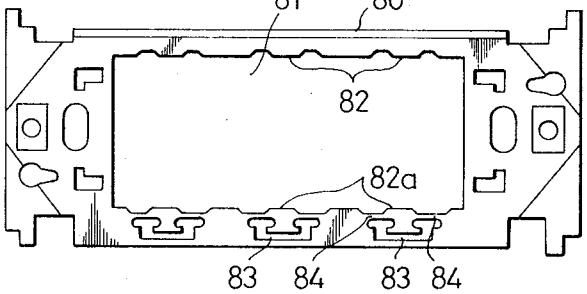
FIG. 8 is a top plan view of another general mounting frame which is metal-made.

Referring next to the mounting of the connector 10 to the metal-made mounting frame 80 with reference to FIG. 8, this frame 80 is provided also with a mounting opening 81 which has along both longitudinal side edges three pairs of lugs 82 and **82*a* extended inward to oppose each other in width direction, and with three U-shaped insertion holes 83 made in one longitudinal side arm of the frame to provide respectively a pair of thin portions 84 on both sides of each of the lugs 82*a* so that a lever action of a suitable tool inserted into the hole 83 for twisting the thin portions 84 will cause the lugs 82*a* to be rotatively shifted. When one of the lugs 82 on one side edge of the mounting opening 81 is engaged into the hole 47 in the extrusion 48 of the body 11 of the coaxial cable connector 10 on the side of, for example, the second skirt 14 with the connector so fitted to the frame 80, opposing one of the lugs 82*a* on the other side edge of the opening 81 is caused to be engaged snap-fittingly into the hole 47*a* in the extrusion 48*a* of the other second skirt 14*a* after being urged to be rotatively shifted, and the connector 10 can be mounted to the metallic frame 80. The lug 81 and hole 47 form a projection and slot connection. Dimensions of the mounting opening 81 of this frame 80, connector 10 and wiring module 59 may be set in the same manner as in the case of FIGS. 6 and 7**.

Figure 9:
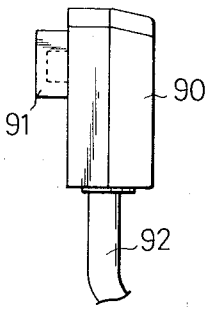
FIG. 9 is a side view of a plug of a coaxial cable connectable to the receptacle of the connector of FIG. 2.

Such a plug 90 as shown in FIG. 9 can be suitably used for coupling another coaxial cable to the receptacle 15 of the coaxial cable connector 10. The plug 90 includes an insert part 91 which can be plugged into the receptacle 15 so that contact terminals (not shown) incorporated in the insert part 91 in a known manner can come into contact with the first and second terminal members 19 and 20 of the receptacle 15. The plug 90 is connected to an end of a coaxial cable 92 connected at the other end to an antenna lead-in terminal block mounted on an outer body of TV receiver. The inner and outer conductors of the cable 92 are electrically connected to the respective contact terminals in the insert part 91 of the plug 90.

Figure 10:
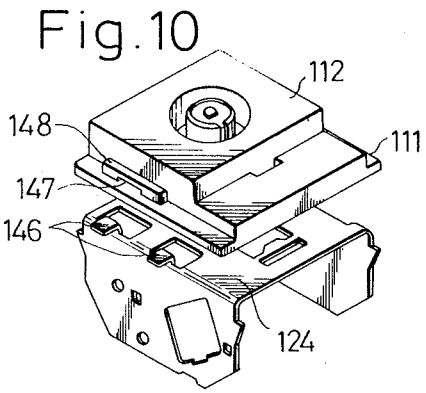
FIG. 10 is a perspective view as disassembled of major parts of the coaxial cable connector in another embodiment according to the present invention.

While the engaging lugs 46 and **46*a* for mounting the connector to the plastic mounting frame 50 have been provided in the connector body 11 in the embodiment of FIGS. 1 to 5, the body may not be provided with such lugs, as in another embodiment of the connector according to the present invention shown in FIG. 10, in which an upper half 124 of a shield casing of the connector body 111 is provided with a pair of engaging lugs 146 at each bent corner of the upper half 124, as cut and bent to extend outward. Other arrangement and operation ofthe present embodiment are substantially the same as those of the embodiment of FIGS. 1 to 5, and some members corresponding to those in FIGS. 1 to 5** are denoted by the same reference numerals but added by 100.

Figure 11:
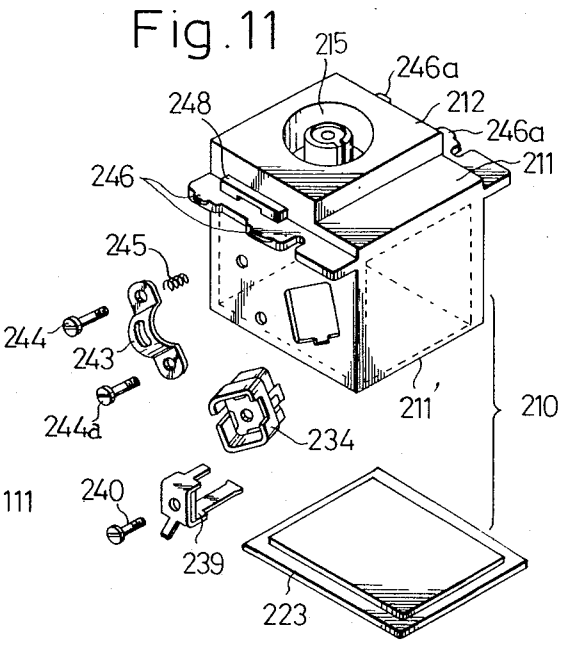
FIG. 11 is a perspective view of the connector in still another embodiment according to the present invention.

The shield casing 23 has been set forth as being made of an electrically conductive metal in the embodiment of FIGS. 1 to 5, but the casing may be made of a plastic material in such manner that, as in an embodiment of FIG. 11, the plastic-made connector body 211 is provided on the lower side with an integral casing part 211', the bottom end of which is opened but is closed by a bottom cover 223 also of a plastic material, and a thin metal layer is applied to the outer peripheral wall surfaces of the casing part 211' and to the outer surface of the bottom cover 223 by means of a proper plating, depositing or coating technique, so as to be directly connected to the outer conductor of an antenna cable and thus to provide the shielding function to the plastic-made casing with respect to the external electric field. In this case, the electric connection between the inner and outer conductors of the antenna cable and the first and second terminal members of the receptacle 215 may be achieved by means of, for example, a printed circuit provided directly or through a substrate onto the inner wall surfaces of the casing part 211' and base part 212 and brought into contact with the terminal members and with the connecting member 239 and holding-member fixing screws 244 and 244a. Other arrangement and operation of the instant embodiment are substantially the same as those of the embodiment of FIGS. 1 to 5, and major members corresponding to those in FIGS. 1 to 5 are denoted by the same reference numerals but added by 200.

The coaxial cable connector of the foregoing arrangements according to the present invention achieves remarkable effects in such that, as the connector is mountable, in common, to the generally used mounting frame for the house wiring modules such as switches, plug-sockets and the like, the entire house wiring works can be simplified while maintaining a favourable room interior appearance, and the use of the plug for connection of the conductors of the interior-side coaxial cable to the connector terminals causes the conductors and terminals not to be exposed directly to the atmosphere so that their interconnection can be prevented from being deteriorated.

What is claimed as our invention is:

1. A coaxial cable connector in combination with a wiring-module mounting frame of the type to be mounted in a recess of an interior wall of a building, whereby said connector will be exposed to receive a coaxial cable, said wiring-module mounting frame including an opening extending completely therethrough and bordered by a pair of opposing edges, and first engaging means situated on each of said edges, said connector comprising a generally flat plastic body fitted within said opening and having a generally flat front surface and a rear surface, said front surface formed on a base part of said body, a receptacle formed in said front surface and including a forwardly open front end, said receptacle including first and second electrically insulated terminal members adapted to be electrically connected to an end plug of a coaxial cable, a casing mounted to said body and extending from said rear surface of said body and disposed within said opening of said wiring-module mounting frame, said casing comprising a side wall which includes a surface facing laterally away from a longitudinal axis defined by said receptacle, first and second connecting means electrically insulated from one another and secured to said surface and adapted to be connected, respectively, to a pair of conductors of another coaxial cable, said first and second connecting means being electrically connected, respectively, to said first and second terminal members, said casing comprising an electrically conductive material which electrically interconnects one of said connecting means to one of said terminal members, second engaging means formed on mutually opposite sides of one of said body and casing and operably connected to said first engaging means on said opposing edges of said wiring-module mounting frame, said first and second engaging means defining a projection and slot connection, the projection of which extends laterally relative to said longitudinal axis, the placement of said connector in said frame being such that said connector is situated in and behind said opening except for said base part which projects slightly forwardly beyond said opening so that said front surface and said front end of said receptacle are disposed forwardly of said opening.

2. A combination according to claim 1, wherein the dimensions of said body substantially correspond in width to that of said mounting opening of said mounting frame, the length of said opening being longer than the length of said connector, with a separate wiring module mounted in said opening adjacent said connector.

3. A coaxial cable connector adapted to be connected to a wiring-module mounting frame of the type to be mounted in a recess of an interior wall of a building whereby said connector can be inserted into an opening of the frame and exposed to receive a coaxial cable, the opening of the frame extending completely therethrough and bordered by a pair of opposing edges, and first engaging means situated on each of said edges, said connector comprising a generally flat plastic body adapted to be fitted within the opening of the wiring module mounting frame and having a generally flat front surface and a rear surface, said front surface formed on a base part of said body, a receptacle formed in said front surface and including a forwardly open front end, said receptacle including first and second electrically insulated terminal members adapted to be electrically connected to an end plug of a coaxial cable, a casing mounted to said body and extending from said rear surface of said body and adapted to be disposed within the opening of the wiring-module mounting frame, said casing comprising a side wall which includes a surface facing laterally away from a longitudinal axis defined by said receptacle, first and second connecting means electrically insulated from one another and secured to said surface and adapted to be connected, respectively, to a pair of conductors of another coaxial cable, said first and second connecting means being electrically connected, respectively, to said first and second terminal members, said casing comprising an electrically conductive material which electrically interconnects one of said connecting means to one of said terminal members, second engaging means formed on mutually opposite sides of one of said body and casing and adapted to be connected to the first engaging means of the wiring-module mounting frame, said first and second engaging means defining a projection and slot connection, the projection of which extends laterally relative to said longitudinal axis, said connector being configured such that when mounted in said frame said connector is situated in and behind said opening except for said base part which projects slightly forwardly beyond said opening so that said front surface and said front end of said receptacle are disposed forwardly of said opening.

4. A combination according to claim 3, wherein said body has a skirt extended therefrom in a longitudinal lengthwise direction of said opening of said mounting frame, said skirt being stepped rearwardly from said front surface, the length of said body being less than the length of the opening to permit a wiring module to be mounted in said opening in spaced relationship from an adjoining skirt of said body.

5. A connector according to claim 3, wherein said casing comprises upper and lower halves, respectively, made of electrically conductive plate material bent and formed so as to be interdigitatingly engageable to each other to define a space therein.

6. A connector according to claim 3, wherein said body is made of a plastic material, and said casing comprises a casing body provided on a bottom face of the body to be integral therewith and open at the bottom, and a bottom cover made of a plastic material and secured to said bottom opening of said casing body, the entire outer peripheral surfaces of said casing body and bottom surface of said bottom cover being provided with a thin metal layer.

7. A connector according to claim 3, wherein one of said body and casing includes third engaging means operatively engageable with engaging means of a different type of wiring-module mounting frame.

8. A connector according to claim 3, wherein said first and second terminal members are formed on a single post disposed in said receptacle.

* * * * *